United States Patent [19]

Chasan

[11] Patent Number: 4,639,961

[45] Date of Patent: Feb. 3, 1987

[54] SYSTEM FOR REMOVING AIR FROM WATERBED

[76] Inventor: Dow B. Chasan, 399 Indian Hill, Buffalo Grove, Ill. 60090

[21] Appl. No.: 645,346

[22] Filed: Aug. 29, 1984

[51] Int. Cl.[4] ..... A47C 21/00

[52] U.S. Cl. ..... 5/508; 5/451

[58] Field of Search ..... 5/451, 508; 29/110.5, 29/110, 111, 112; 38/100, 101; 15/230.11; 7/111; 269/242

[56] References Cited

U.S. PATENT DOCUMENTS

| | | | |
|---|---|---|---|
| 72,921 | 12/1867 | Shellerbock | 269/242 |
| 1,862,858 | 6/1932 | Lyon | 269/242 |
| 2,434,462 | 1/1948 | Kempthorne | 15/230.11 |
| 3,714,674 | 2/1973 | Simoncioni | 15/230.11 |
| 4,314,395 | 2/1982 | Brock | 29/110.5 |
| 4,476,806 | 10/1984 | Lubniewski et al. | 29/110.5 |

FOREIGN PATENT DOCUMENTS

| | | | |
|---|---|---|---|
| 555775 | 6/1923 | France | 269/242 |

*Primary Examiner*—Gary L. Smith
*Assistant Examiner*—Michael F. Trettel
*Attorney, Agent, or Firm*—George H. Gerstman

[57] ABSTRACT

A device is provided for removing air from a waterbed having a water/air valve. The device includes an elongated member having a length that is almost as wide as the width of the waterbed. A pair of smaller members which are parallel to each other and have axes that are perpendicular to the axis of the elongated member, are coupled to the roller support member. The smaller members are coupled in sliding relationship to the elongated member.

To remove air from the waterbed, the elongated member is positioned at the end of the bed farthest from the water/air valve. The elongated member is moved toward the water/air valve to compress the waterbed longitudinally. When the elongated member is adjacent the water/air valve, then the waterbed is compressed laterally in the area that has not been compressed by the elongated roller, by moving the smaller members inwardly toward the air/water valve.

10 Claims, 10 Drawing Figures

FIG. 1
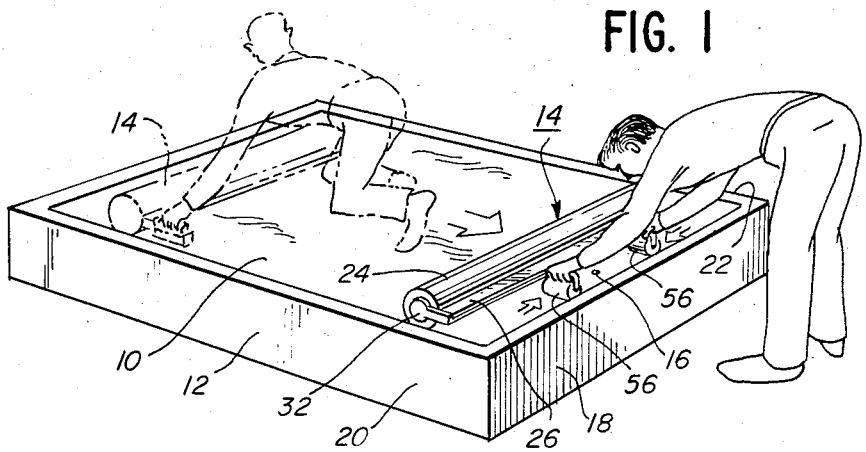
FIG. 3
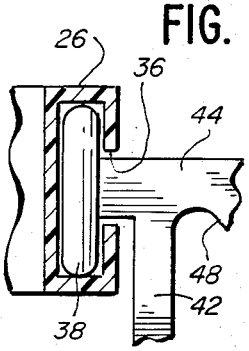
FIG. 2
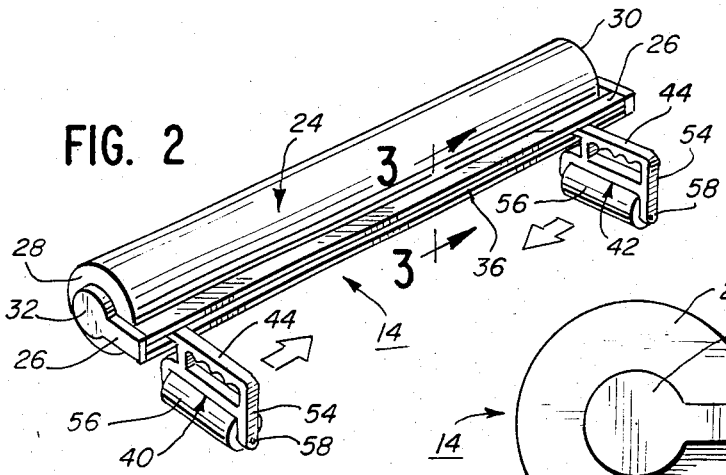
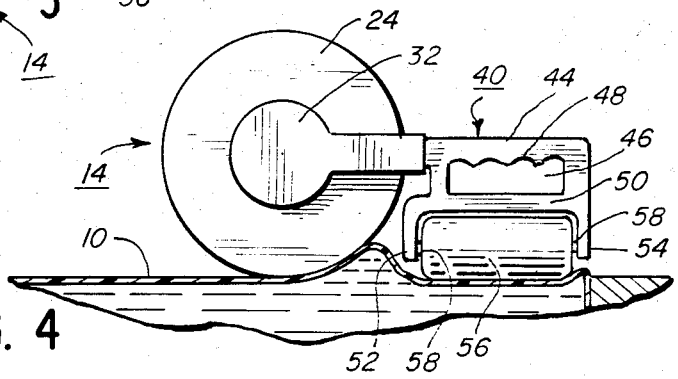
FIG. 4
FIG. 5
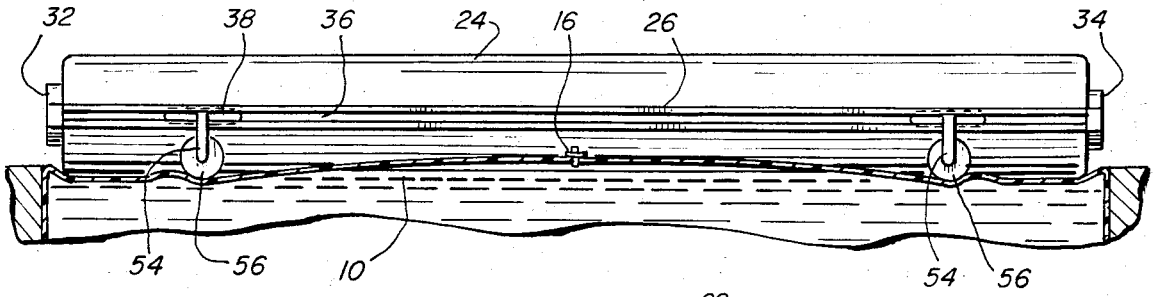
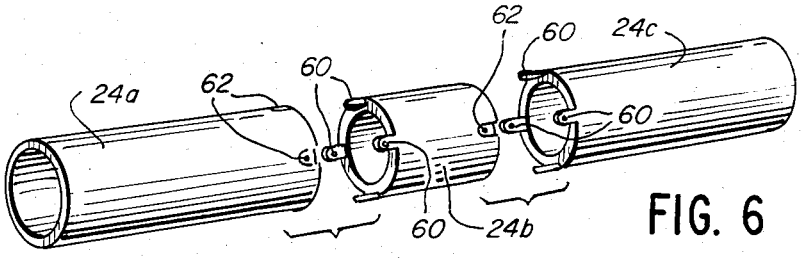
FIG. 6

SYSTEM FOR REMOVING AIR FROM WATERBED

BACKGROUND OF THE INVENTION

The present invention concerns a novel device and method for removing air from a waterbed having a water/air valve.

Occasionally air must be removed from waterbeds. For example, when the waterbed is filled with water, or algaecide is added to it, it is necessary to remove air from the waterbed. Conventionally a water/air valve is provided near one end of the waterbed, in a central position. To remove air from the waterbed, it is typical for a person to move his body over the waterbed to compress the air in the waterbed and force it towards the water/air valve and outward therefrom.

I have found that the moving of one's body over a waterbed in an effort to remove the air therefrom is cumbersome and inefficient. It is, therefore, an object of my invention to provide a device and method that more effectively removes air from a waterbed having a water/air valve.

Another object of my invention is to provide a device for removing air from a waterbed having a water/air valve, which device is efficient to manufacture and simple to operate.

Another object of my invention is to provide a method for removing air from a waterbed having a water/air valve, which method is simple in operation and more effective than the known procedure of rolling one's body over the bed.

Other objects and advantages of the present invention will become apparent as the description proceeds.

BRIEF DESCRIPTION OF THE INVENTION

In accordance with the present invention, I have provided a device for removing air from a waterbed having a water/air valve.

The device comprises an elongated member having a length that is substantially the width of the bed. The elongated member is adapted for manual movement of the elongated member over a substantial length of the waterbed to provide longitudinal compression of the waterbed. Lateral movable means are coupled to the elongated member for providing lateral compression in addition to the longitudinal compression provided by the elongated member.

In one embodiment, the elongated member has sliding means. The lateral movable means are connected to the slidable means so that the lateral movement means is slidable with respect to the elongated member. The sliding means comprises a slot and the lateral movable means is slidable within the slot. The lateral movable means comprises a pair of secondary members, each of which is smaller than the elongated member. The secondary members are positioned parallel to each other and extend perpendicular to the axis of the elongated member.

In one embodiment, the elongated member comprises a plurality of connectable elements.

In another embodiment, the device comprises an elongated roller having a length that is almost the width of the bed. A roller support member is connected at opposed ends of the elongated roller, with the roller being rotatable with respect to the roller support member. Means are provided for grasping the roller support member, to enable manual movement of the roller over a substantial length of the waterbed to provide longitudinal compression of the waterbed. Lateral movable means are coupled to the roller support member for providing lateral compression in addition to the longitudinal compression provided by the elongated roller.

In this illustrative embodiment, the roller support member comprises a rack having sliding means parallel to the axis of the roller. The lateral moving means is connected to the slidable means whereby the lateral movable means is slidable with respect to the roller support member. The slidable means comprises a slot and the lateral movable means is slidable within the slot. The grasping means includes a pair of handles defined by the lateral movable means. The lateral movable means comprises a pair of rollers positioned parallel to each other with their respective axes being perpendicular to the axis of the elongated roller.

In accordance with the method of my invention, the method comprises the steps of providing an elongated member having a length that is substantially the width of the bed, positioning the elongated member at the end of the bed farthest from the water/air valve, moving the member toward the water/air valve to compress the waterbed longitudinally, and when the elongated member is adjacent the water/air valve, then compressing the waterbed laterally in the area that has not been compressed by the elongated member, from the sides of the waterbed inwardly toward the water/air valve.

In another embodiment of the invention, the method comprises the steps of providing an elongated roller having a length that is almost the width of the bed, positioning the elongated roller at the end of the bed farthest from the water/air valve, rolling the roller toward the water/air valve to compress the waterbed longitudinally, and when the elongated roller is adjacent the water/air valve, then compressing the waterbed laterally in the area that has not been compressed by the elongated roller, from the sides of the waterbed inwardly toward the water/air valve.

In this illustrative embodiment, the method includes the steps of providing a pair of rollers that are each smaller than the elongated roller for compressing the waterbed laterally as aforesaid, with the smaller rollers having axes that are perpendicular to the axis of the elongated roller.

A more detailed explanation of the invention is provided in the following description and claims, and is illustrated in the accompanying drawing.

BRIEF DESCRIPTION OF THE DRAWING

FIG. 1 is a perspective view of a device and method for removing air from a waterbed having a water/air valve, in accordance with the principles of the present invention;

FIG. 2 is a perspective view of the device of FIG. 1, showing additional details;

FIG. 3 is a cross-sectional view taken along the plane of the line 3—3 of FIG. 2;

FIG. 4 is a side elevational view of the device of FIG. 2;

FIG. 5 is a front elevational view of the device of FIG. 2;

FIG. 6 is a modification of the invention, whereby the elongated roller of FIG. 2 comprises a plurality of connectable elements;

DETAILED DESCRIPTION OF THE ILLUSTRATIVE EMBODIMENTS

Figure 7:
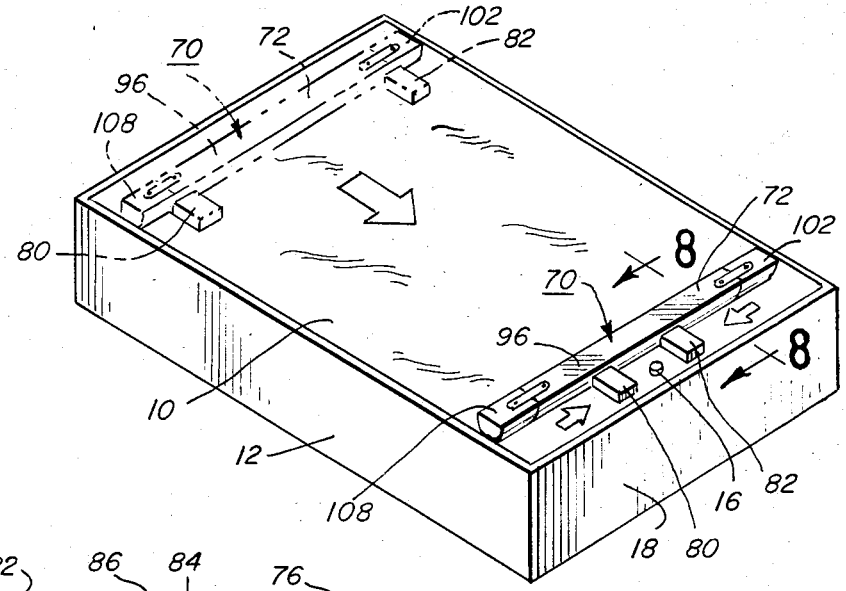
FIG. 7 is a perspective view of a device and method for removing air from a waterbed having a water/air valve, in accordance with another embodiment of the present invention.

Referring to the drawings, in FIG. 1 a waterbed 10 is illustrated within a bed frame 12. A device 14 for removing air from the waterbed, to be explained in more detail below, is illustrated in phantom lines at one end of the bed and in full lines at the opposite end of the bed adjacent the water/air valve 16 of the waterbed 10. The use of a water/air valve 16 is conventional in waterbeds and it is generally provided as illustrated, with the location being close to one end 18 of the waterbed and central with respect to sides 20, 22.

Referring to FIG. 2, device 14 comprises an elongated roller 24, preferably blow molded of plastic and preferably having a length that is substantially the width of the waterbed.

A roller support member 26 in the form of a rack is connected at opposed ends 28, 30 of the elongated, cylindrical roller 24. The roller support member 26 includes end members 32, 34, with respect to which the elongated roller 24 is rotatable. The roller support member or rack 24 is preferably molded of plastic material and defines a slot 36 which operates as sliding means for receiving members 38. Members 38 comprise a portion of lateral movable means 40, 42. The lateral moving means 40, 42 are identical to each other and each comprises an upper member 44 connected to or formed with sliding member 38. Upper member 44 is defined by an opening 46 which operates to form a handle having finger slots 48 and also forms a lower portion 50 having downwardly extending end members 52, 54. A roller 56, that is much smaller than elongated roller 24, is positioned within portion 50 and lower members 52, 54, as illustrated most clearly in FIG. 4. Roller 56 carries a pair of axial pins 58 which are set within recesses defined by lower members 52 and 54, to enable roller 56 to rotate with respect to lower members 52, 54.

By referring to FIG. 2, it can be seen that the lateral movable means 40, 42 with rollers 56 are parallel to each other and the axes of rollers 56 extend perpendicular to the axis of elongated roller 24. Thus the handles defined by upper member 44 and slot 46 may be manually grasped, the laterally movable means 40, 42 can be moved toward and away from each other, and the rollers 56 can rotate about axes that are perpendicular to the axis of elongated roller 24.

In the operation of the device, the device is positioned at the far end of the waterbed 10, as illustrated in the phantom lines in FIG. 1. The handles and rollers 56 are extended outwardly, away from each other, as illustrated.

The operator then moves the roller longitudinally along the waterbed, in the direction of the arrow of FIG. 1 until elongated roller 14 is positioned adjacent the water/air valve. This movement of the roller will compress the waterbed longitudinally. Once the roller 14 is adjacent the water/air valve, then the operator moves his hands toward each other to compress the waterbed laterally in the area that has not been compressed by the elongated roller, from the sides of the waterbed inwardly toward the water/air valve. Movement of rollers 56 toward each other will act to compress the air and force it toward the water/air valve so that a substantial amount of the air that was trapped within the waterbed has now been vented by the longitudinal compressive action of roller 24 and the lateral compressive action of rollers 56. Once the rollers 56 are moved together in the direction of the arrows of FIG. 1 and FIG. 2, and the air has been released from the waterbed, the water/air valve 16 is capped.

As illustrated in FIG. 6, the elongated roller could comprise a plurality of connectable elements. In this manner, for example, elongated rollers can be connected so as to conform substantially to the width of different width beds. For example, section 24*a* (FIG. 6) may be substantially the width of a twin size bed. By connecting section 24*b* to section 24*a*, the elongated roller may have the substantial width of a double bed. By further connecting section 24*c*, the elongated roller may have the substantial dimension of a king size bed. In the illustrative embodiment of FIG. 6, the sections are connected by means of tabs 60 which interengage with grooves 62, although other connecting means may be utilized. Further, the size of the sections may vary according to storage limitations, as well as according to bed widths.

Now referring to FIG. 7, a device 70 for removing air from a waterbed is shown therein. Device 70 comprises an elongated member 72 having a circular underside 74 and a flat top side 76. Elongated member 72 defines a longitudinal slot 78 (FIGS. 8 and 9) which slots 78 extend parallel to the axis of elongated member 72.

A pair of secondary members 80, 82 are provided. Secondary members 80, 82 are equal in height to elongated member 72 and each of the secondary members carries a pair of lugs 84 which are fastened to secondary members 80, 82 by suitable connecting means 86.

Figure 8:
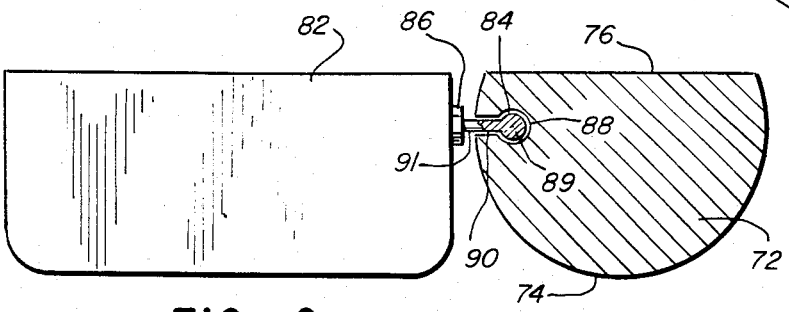
FIG. 8 is an enlarged cross-sectional elevation of the elongated member and a secondary member, taken along the plane of the line 8—8 of FIG. 7.
Figure 9:
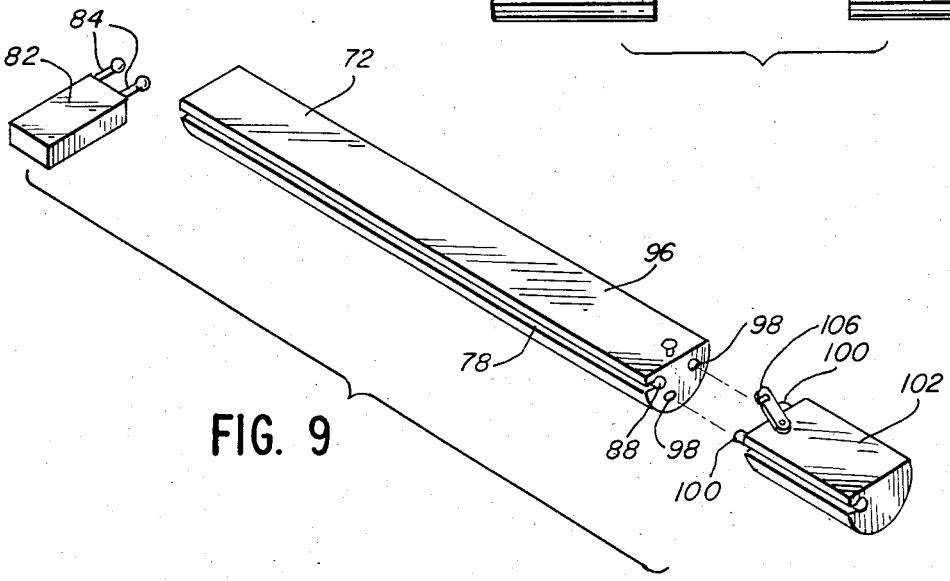
FIG. 9 is an exploded perspective view of the members of FIGS. 7 and 8.

As illustrated most clearly in FIGS. 8 and 9, slot 78 comprises a large circular portion 88 for receiving the spherical ends 89 of lugs 84 and a smaller portion 90 opening to the outside for receiving the neck 91 of lugs 84. It can readily be seen how the lugs 84 slide within slot 78.

Secondary members 80, 82 are much smaller than elongated member 72 and extend perpendicular to the axis of elongated member 72. In the operation of the device, device 70 is placed at the end of the bed farthest from end 18, with secondary members 80, 82 spaced as far apart from each other as possible. Elongated member 72 is then manually pulled toward the water/air valve 16, compressing the air within the waterbed and forcing it toward the water/air valve 16. Once elongated member 72 is adjacent water/air valve 16, and the air is substantially trapped in the lowest volume of the bed, secondary members 80, 82 are moved toward each other to compress the air laterally and force the air out of water/air valve 16. Once the air is removed, the water/air valve 16 is capped.

Figure 10:
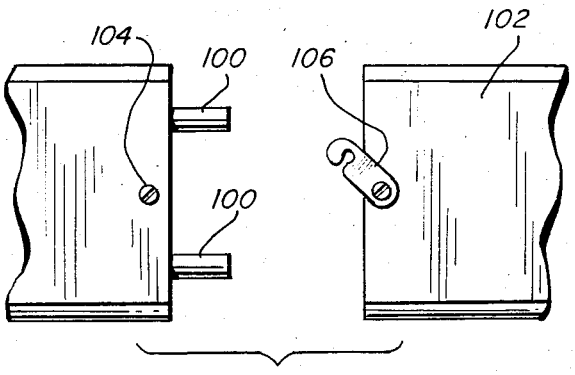
FIG. 10 is a view showing how the connectable elements forming an elongated member are connected to each other.

It is preferred that elongated member 72 comprise a plurality of connectable elements. Referring to FIGS. 9 and 10, it is seen that main portion 96 of elongated member 72 defines a pair of openings 98 for receiving dowels 100 which are carried by connectable portion 102. Main elongated member 96 also carries a screw 104 which is hooked by a suitable hook 106 carried by the other portion 102. Of course the screw 104 and hook 106 could be carried by either member and FIG. 10 shows these items reversed.

Referring back to FIG. 7, it is seen that main portion 96 of elongated member 72 has connected to it an additional portion 102 and another additional portion 108, so that the elongated member is long enough to be operable with king size bed 10. As an example, portion 96 could be used alone with a double bed, portion 102 could be added for a queen size bed, and portion 108 could be added for a king size bed. Each of the connectable portions defines slot 78 so that when the portions are connected together, slot 78 will be continuous, as illustrated in FIGS. 7 and 9.

It is seen that a novel device and method have been illustrated and described for removing air from a waterbed having a water/air valve, which device is easy to manufacture and simple in operation and which method is highly effective to achieve an efficient result. Although illustrative embodiments of the invention have been shown and described, it is to be understood that various modifications and substitutions may be made without departing from the novel spirit and scope of the present invention.

What is claimed is:

1. A device for removing air from a waterbed having a water/air valve which comprises:

an elongated cylindrical roller having a length that is substantially the width of the bed;

a roller support member connected at opposed ends of the cylindrical roller, with the roller being rotatable with respect to the roller support member;

means for grasping the roller support member to enable manual movement of the roller over a substantial length of the waterbed to provide longitudinal compression of the waterbed;

lateral movable means coupled to the roller support member for providing lateral compression in addition to the longitudinal compression provided by the elongated roller;

said roller support member comprising a rack having sliding means parallel to the axis of the roller; said lateral movable means being connected to said slidable means whereby said lateral movable means is slidable with respect to said roller support member.

2. A device as described in claim 1, said sliding means comprising a slot and said lateral movable means being slidable within said slot.

3. A device as described in claim 1, said lateral movable means comprising a pair of rollers, each of which is smaller than said elongated roller, positioned parallel to each other and with their respective axes being perpendicular to the axis of the elongated roller.

4. A device for removing air from a waterbed having a water/air valve, which comprises:

an elongated member having a length that is substantially the width of the bed, said elongated member being adapted for manual movement of the elongated member over a substantial length of the waterbed to provide longitudinal compression of the waterbed;

lateral movable means coupled to the elongated member for providing lateral compression in addition to the longitudinal compression provided by the elongated member;

said elongated member having sliding means;

said lateral movable means being connected to said slidable means whereby said lateral movable means is slidable with respect to said elongated member;

whereby said elongated member may be provided at the end of the bed farthest from the water/air valve, moved toward the water/air valve to compress the waterbed longitudinally, and when the elongated member is adjacent the water/air valve, then the waterbed may be compressed laterally by said lateral movable means from the sides of the waterbed inwardly toward the water/air valve.

5. A device as described in claim 4, said elongated member comprising a plurality of connectable elements.

6. A device as described in claim 4, said sliding means comprising a slot and said lateral movable means being slidable within said slot.

7. A device as described in claim 4, said lateral movable means comprising a pair of secondary members, each of which is smaller than said elongated member, positioned parallel to each other and extending perpendicular to the axis of the elongated member.

8. A device for removing air from a waterbed having a water/air valve, which comprises:

an elongated cylindrical roller having a length that is substantially the width of the bed;

a roller support member connected at opposed ends of the elongated roller, with the roller being rotatable with respect to the roller support member;

a pair of handles for grasping the roller support member to enable manual movement of the elongated roller over a substantial length of the waterbed to provide longitudinal compression of the waterbed; and lateral movable means coupled to the roller support member for providing lateral compression in addition to the longitudinal compression provided by the elongated roller, said roller support member comprising a rack having sliding means parallel to the axis of the roller, said lateral movable means being connected to said slidable means whereby said lateral movable means is slidable with respect to said roller support member, said slidable means comprising a slot and said lateral movable means being slidable within said slot, said handles being defined by said lateral moving means, said lateral moving means comprising a pair of rollers positioned parallel to each other with their respective axes perpendicular to the axis of the elongated roller.

9. A method for removing air from a waterbed having a water/air valve, which comprises the steps of:

providing an elongated roller having a length is substantially the width of the bed;

positioning the elongated roller at the end of the bed farthest from the water/air valve;

rolling the roller toward the water/air valve to compress the waterbed longitudinally; and when the elongated roller is adjacent the water/air valve, then compressing the waterbed laterally in the area that has not been compressed by the elongated roller, from the sides of the waterbed inwardly toward the water/air valve, including the step of providing a pair of rollers that are each smaller than said elongated roller for compressing the waterbed laterally as aforesaid, said smaller rollers having axes that are perpendicular to the axis of the elongated roller.

10. A method for removing air from a waterbed having a water/air valve, which comprises the steps of:

providing an elongated roller having a length is substantially the width of the bed;

positioning the elongated roller at the end of the bed farthest from the water/air valve;

rolling the roller toward the water/air valve to compress the waterbed longitudinally; and when the elongated roller is adjacent the water/air valve, then compressing the waterbed laterally in the area that has not been compressed by the elongated roller, from the sides of the waterbed inwardly toward the water/air valve, including the steps of providing handles which slide in a direction that is parallel to the axis of the elongated roller;

providing a pair of rollers coupled to the handles with the rollers being parallel to each other and having axes that are perpendicular to the axis of the elongated roller;

when the elongated roller is adjacent the water/air valve, then compressing the waterbed laterally with the roller pair in the area that has not been compressed by the elongated roller, from the sides of the waterbed inwardly toward the water/air valve.

* * * * *